US006966159B2

(12) United States Patent
Skendžić et al.

(10) Patent No.: US 6,966,159 B2
(45) Date of Patent: Nov. 22, 2005

(54) FLAT SOFFIT, DOUBLY PRESTRESSED, COMPOSITE, ROOF-CEILING CONSTRUCTION FOR LARGE SPAN INDUSTRIAL BUILDINGS

(75) Inventors: Milovan Skendžić , Lepoglava (HR); Branko Šmrček, Trnovec (HR)

(73) Assignee: Mara-Institut d.o.o., Donji Martijanec (HR)

( * ) Notice: Subject to any disclaimer, the term of this patent is extended or adjusted under 35 U.S.C. 154(b) by 92 days.

(21) Appl. No.: 10/432,598

(22) PCT Filed: Oct. 2, 2001

(86) PCT No.: PCT/HR01/00045

§ 371 (c)(1),
(2), (4) Date: Jun. 3, 2003

(87) PCT Pub. No.: WO02/053852

PCT Pub. Date: Jul. 11, 2002

(65) Prior Publication Data

US 2004/0025457 A1 Feb. 12, 2004

(30) Foreign Application Priority Data

Dec. 28, 2000 (CR) ..... P20000906A

(51) Int. Cl.[7] ..... E04C 3/293

(52) U.S. Cl. ..... 52/223.14; 52/223.8; 52/640; 52/724.1

(58) Field of Search ..... 52/223.8, 223.14, 52/223.1, 640, 690, 724.1

(56) References Cited

U.S. PATENT DOCUMENTS 2,626,688 A * 1/1953 Lagaard ..... 52/640
3,260,024 A 7/1966 Greulich
3,385,015 A * 5/1968 Hadley ..... 52/223.8
3,398,498 A * 8/1968 Krauss ..... 52/691
3,835,607 A * 9/1974 Raaber ..... 52/223.8
5,299,445 A * 4/1994 Yee ..... 52/745.19
5,305,572 A * 4/1994 Yee ..... 52/223.8
5,852,905 A * 12/1998 Collina et al. ..... 52/223.8
5,867,954 A * 2/1999 Lin ..... 52/223.12
6,058,666 A * 5/2000 Lin ..... 52/223.8
6,332,301 B1 * 12/2001 Goldzak ..... 52/729.2
2003/0182883 A1 * 10/2003 Won ..... 52/223.8

FOREIGN PATENT DOCUMENTS

| | | |
|---|---|---|
| DE | 1 659 218 | 1/1971 |
| FR | 2 238 824 | 2/1975 |
| FR | 2 600 358 | 12/1987 |
| GB | 1 228 598 | 4/1971 |

* cited by examiner

*Primary Examiner*—Brian E. Glessner
(74) *Attorney, Agent, or Firm*—Jacobson Holman PLLC

(57) ABSTRACT

A prestressed, roof-ceiling construction with flat-soffit for constructing an industrial large-span building with a bearing plane-space by assembling pre-fabricated elements. A problem of constructing flat-soffit, finished ceilings in large-span buildings is solved whereby besides an aesthetic ceiling look, the heating volume is reduced, ventilation is ensured and an isolated loft space is provided through which all kinds of installations can be guided. The construction includes a wide and thin concrete plate with a two-part upper, steel construction, interconnected by vertical elements. The construction is twice prestressed by two independent methods. The soffit concrete plate is prestressed centrally in the mould and after the plate concrete is hardened, the upper steel construction is prestressed by pushing apart, at the midspan, the steel separated halves which are then connected. Prestressing of the soffit plate is applied to eliminate or reduce cracks in its concrete while prestressing of the upper construction by pushing apart the steel separated halves is used to control the deflections.

4 Claims, 3 Drawing Sheets

FLAT SOFFIT, DOUBLY PRESTRESSED, COMPOSITE, ROOF-CEILING CONSTRUCTION FOR LARGE SPAN INDUSTRIAL BUILDINGS

This is a nationalization of PCT/HR01/00045 filed Oct. 2, 2001 and published in English.

TECHNICAL FIELD

The present invention relates to the field that generally relates to constructions and to building elements.

TECHNICAL PROBLEM

The double prestressed, composite, roof-ceiling constructions with flat-soffit ceilings are plane-space bearing prefabricated elements for constructing industrial large-span buildings that solve several partial technical problems intending to achieve the following: to construct the flat-soffit in large-span buildings eliminating generally an unaesthethic view to the roof construction from the interior of the building, eliminating the unuseful space between sloping roof girders and reducing the unnecessary heated volume of the interior, to form naturally ventilated space between ceiling and roof that saves heating energy and enables installations to be guided invisibly through the shallow loft space, to safely work at heights and to increase the speed of large-span roof ceiling constructed by use of a large-panel but with relatively light elements.

The solution of the above mentioned technical problems is focused to the solution of the constructive technical problem to ensure bearing capability, the proper serviceability characteristics and durability of the construction preventing too large deflections and width of cracks of the slender soffit concrete plate.

The use of the ordinary reinforced-concrete soffit-plate would reduce the span of these slender constructions and would make the long-term serviceability characteristics of the construction become unreliable.

Too large deflections of the reinforced concrete soffit-plate could be decreased by applying stiffer upper construction or to be compensated by the counter-deflection in form but that would be only an uneconomical and unreliable manner to reduce deflections whereby the problem of cracks would remain unsolved.

The reinforced-concrete soffit-plate applied to a large span undergoes a great amount of tension that causes cracks and their progress due to concrete creep and shrinkage whereby the magnitude of deflection increases interactively as the width of cracks increase. The initial cracks in the soffit-plate due to a combination of the large tension axial force and a small-amount local bending moments concentrated locally at points where the upper construction is connected to the soffit plate, growing wider in time, instead are distributed along the whole length of the soffit-plate, which would be more desired in reinforced concrete behavior.

The problem is therefore focused to the proper prestressing method that can reliably and durably counteract the large deflection and eliminate or reduce concrete cracking in the high-tensioned soffit plate, the prestressing method that causes the upward deflection of the concrete soffit-plate and introduces the compression force in it.

This problem can not be solved by the customary concrete-prestressing method because of the specificity of these constructions whereby the central prestressing force applied to the soffit-plate gravity center because of its small eccentricity to the gravity center of overall cross-section can only influence cracks in the soffit-plate and practically does not influence deflections.

The usual prestressing techniques introduce the compressive force into a beam or a concrete-truss construction below the concrete cross-section gravity center that due to specific geometry causes upward deflection of the element solving simultaneously the problem of deflections and the problem of concrete cracking.

The specific composite, roof-ceiling, flat-soffit construction, because its overall cross-section gravity center is placed at negligibly small eccentricity from the soffit-plate can not be prestressed by the usual prestressing method introducing the compressive force into concrete body to obtain the counter-deflection of the soffit plate upwards and to close its cracks simultaneously.

Introducing of such a prestressing force at the eccentricity below the cross-section gravity center would require positioning of the tendon gravity center below the soffit-plate level that would ruin the flat soffit.

The application of central prestressing that would introduce compressive force into the soffit-plate gravity center because of the small eccentricity influences only cracks but it does not influence deflections at all. The additional technical problem at large spans is stabilizing upper slender construction against lateral buckling over the entire length that can cause its instability and collapse of entire construction.

BACKGROUND OF THE ART

The present invention concerns specific composite, roof-ceiling constructions whereby no simillar solution is know. All the adventages given by the present innovation are enabled owing to the solution of the prestressing method that makes them applicable to large spans suitable for constructing of industrial buildings.

All custom concrete-prestressing methods are adapted to concrete specificities with adapted cross-section shapes whereby indroducing of the prestressing force in a lower zone of the beams, trusses or plates, due to compressive force acting on eccentricity below the gravity center of the cross section, problem of deflections and cracks is solved simultaneously. Several ways of prestressing are customizable in constructing steel buildings whereby some elements of trusses are forced mechanicaly or thermally to introduce prestressing effects.

The above mentioned prestressing methods are well known and are applied to one-material constructions, adapted thereby to its specific characteristics. These constructions, because of their specificities that they have as a composite, made of concrete and steel parts, can not be compared, under the criterion of prestressing effects, to usual ones whereby several technical solutions are applied in the same sense, to introduce the prestressing force below the gravity center of the cross-section.

DISCLOSURE OF THE INVENTION

The present innovation solves prestressing of specific, composite, roof-ceiling, flat-soffit constructions for constructing industrial large-span buildings with some advantages such as: the presence of the flat-soffit in large-span buildings eliminates generally an unaesthetic view to the roof construction from the interior of the building, these constructions, except generally used for hard industries and warehouses, become suitable for fine industries, shops, for example. Pre-fabricated soffit is finished and needs no additional work in site.

Eliminated wasted space between sloping roof girders reduces the heated volume of the interior and saves heating energy.

The naturally ventilated loft that is simply thermo insulated improves the insulation of the roof whereby it enables all installations to be guided invisibly through the shallow loft space, with ensured access for their maintenance instead of being usually guided visibly across the walls and other interior parts.

The safety of workers at heights during assembly and roof covering works is improved because all the work is carried out on the flat surface of soffit plates whereby working in the natural, standing position is enabled.

Use of the plate-like, large-panel elements that cover the big portion of the roof at once has many advantages compared to many custom constructing methods where primary and secondary girders are used.

To achieve above mentioned advantages of these constructions at large spans the problem is focused to the constructive technical solution how to ensure bearing capability, the proper serviceability characteristics and durability of the construction. The problem is solved by double prestressing by the combination of two independent prestressing methods whereby one reduces deflections of the concrete soffit-plate of the construction and the other one eliminates or reduces its cracks due to high tension.

For better understanding of the technical problem that is solved by this invention, on the simplified model shown in FIG. 1 and FIG. 2 the custom prestressing method is compared to prestressing applied to composite flat-soffit roof-ceiling constructions.

By usual methods of prestressing beams or trusses as shown on FIG. 1 the compression force (Po) is introduced below the gravity center of the concrete gravity center (T), at eccentricity (e), in the tension zone or out of it, pushing the beam ends towards the middspan which produces the negative bending moment (M=e×Po) that causes upward beam deflection (u). By such a prestressing the upward deflection reduces the downward deflection of applied external load whereby simultaneously, the applied compressive force (Nt) closes cracks in a tension zone of the beam.

This method is not applicable to specific, composite, roof-ceiling constructions which comprise the wide soffit-plate with low positioned gravity center of the overall cross section. The application of the weighty concrete soffit plate for lower part of the construction with a light upper steel part seems to be illogical because steel that often has stability problems undergoes high compression and concrete that can bear only slight amount of tension is exposed to considerable tension. Nevertheles, this choice is the price that must be paid for achieving the flat soffit and its advantages. Because of such load-bearing illogical choice this prestressing will require more expenses then usual prestressing of concrete. Introducing of the prestressing force (Po) below the gravity center of the cross-section would require descending of the tendon below the soffit plate that would ruin the flatt soffit effect.

The prestressing principle of the present invention shown in FIG. 2 presents a kind of inversion to the usual one.

The upward-deflection (u) effect is obtained by pushing the upper construction separated in the middle, from middle span towards its ends whereby the compressive prestressing force (Po) acts at the eccentricity (e) over the concrete gravity center of the cross-section (T).

In both compared methods, the negative bending moment (M=e×Po) was achieved that produces the upward deflection (u) of the soffit plate. But since by usual prestressing the applied desirable compressive force (Nt) is introduced in the soffit plate, in other case, by pushing the upper construction towards its ends, the undesirable tension force (Nv) was introduced that must be reduced or eliminated by an additional prestressing and this is the price to be paid to achieve the flat soffit.

FIG. 3 shows at the same model this second, additional, central prestressing that introduces the compression force (Nt1) into the soffit-plate by which tension is eliminated, due to both external load and first prestressing, shown at FIG. 2. This second prestressing produces no bending moments because it acts on the negligible eccentricity from concrete gravity center and does not match the deflections achieved by prior prestressing.

Thus, the technical problem of controlling cracks and deflections in the construction is solved by two independent prestressing methods.

On the real model, on FIG. 4, the practical execution of both prestressing methods is illustrated. The upper steel construction comprises two symmetrical, in the middle of the span disconnected halves (2) and vertical connecting elements (3). At the break point in the middle span, there is the detail with vertical wedge by which the upper construction is prestressed and then interconnected. Both halves of upper construction are first positioned to the form (6) for casting the soffit plate.

The steel tendons are prestressed at the mould (4), being previously conducted through holes (5) at the ends of bars (3) to connect steel parts (3) to the concrete soffit plate (1) and the plate (1) is then concreted. After the concrete is hardened the prestressed tendons are released from the form (6) so the soffit plate becomes subjected to the compressive force. The construction is now prestressed by the first step.

The upper construction (2) is now incorporated to the concrete soffit plate (1). The concrete plate is now under the compressive stresses, as shown on FIG. 1, but the soffit plate doesn't undergo upward deflection.

Now additional prestressing is to be applied, by the principle shown in FIG. 2. At the gap in the upper construction (2), the steel wedge (7) is positioned into the connecting channels incorporated in both ends of the separated parts and the driving device (8) that pushes the wedge is prepared.

Driving the steel wedge inside of the detail (7) causes both separated parts of upper construction (2) to push towards the ends of the soffit plate (1) introducing the tension force in it, but the soffit plate is already subjected to previous compression due to first prestressing.

The compressive force introduced by the first prestressing must be of such an amount that after subtraction of the tension due to second prestressing still remains the sufficient compression reserve whereby after subtracting the tension due to applied external load in concrete soffit plate remains tension below the allowed limit or is reduced to zero.

DESCRIPTION OF THE PREFERRED EMBODIMENT

Figure 1:
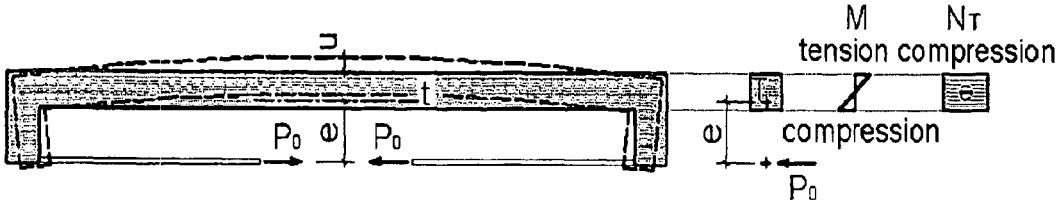
FIG. 1 illustrates on the simplified model the principle of the usual prestressing method by introducing compressive prestressing force below the cross-section gravity center and shows developed internal forces.
Figure 2:
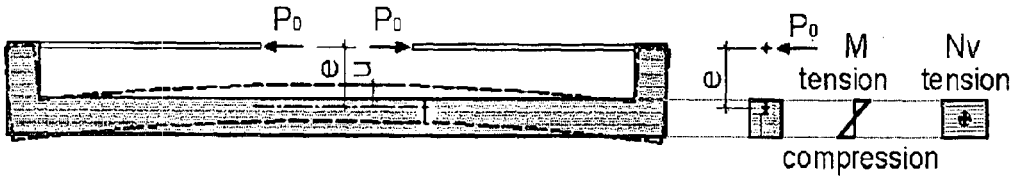
FIG. 2 illustrates on the simplified model the principle of the prestressing method by introducing compressive prestressing force by pushing apart the upper construction, above the cross-section gravity center and shows developed internal forces.
Figure 3:
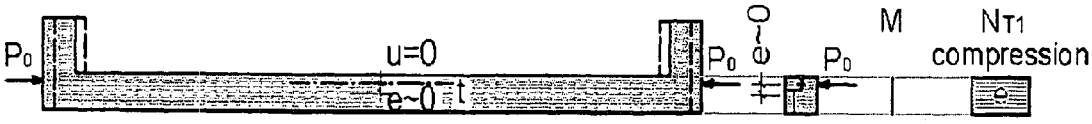
FIG. 3 illustrates on the simplified model additional central prestressing into construction soffit plate and shows developed internal forces.
Figure 4:
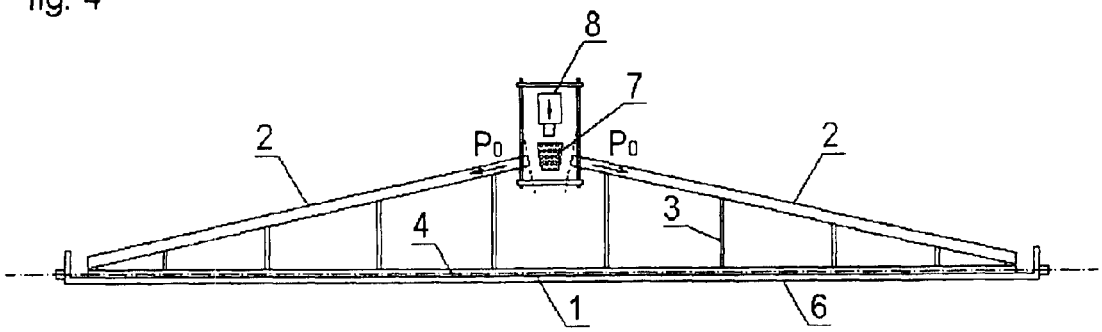
FIG. 4 is the lateral view of a real model necessary to illustrate prestressing methods and the constitutional parts.
Figure 5:
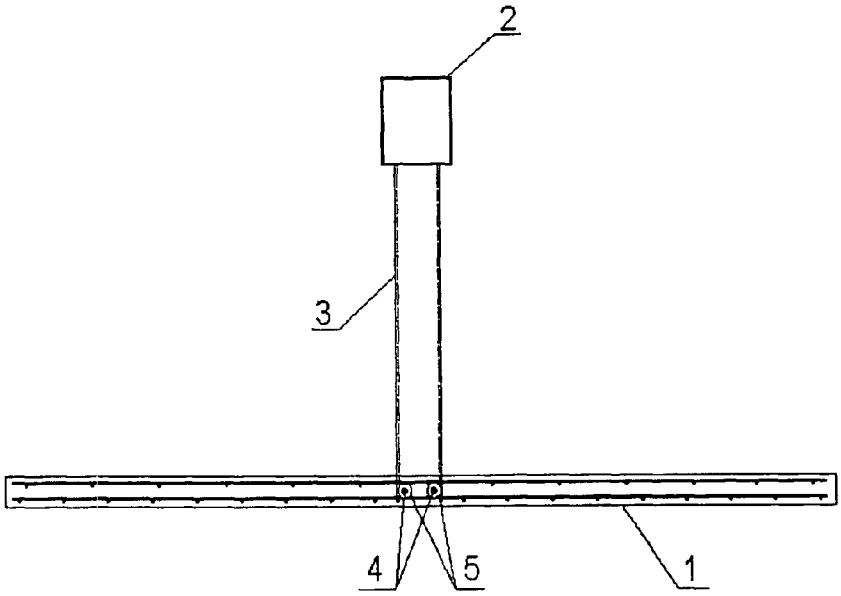
FIG. 5 is the cross-section of the construction with its constitutive parts.
Figure 6:
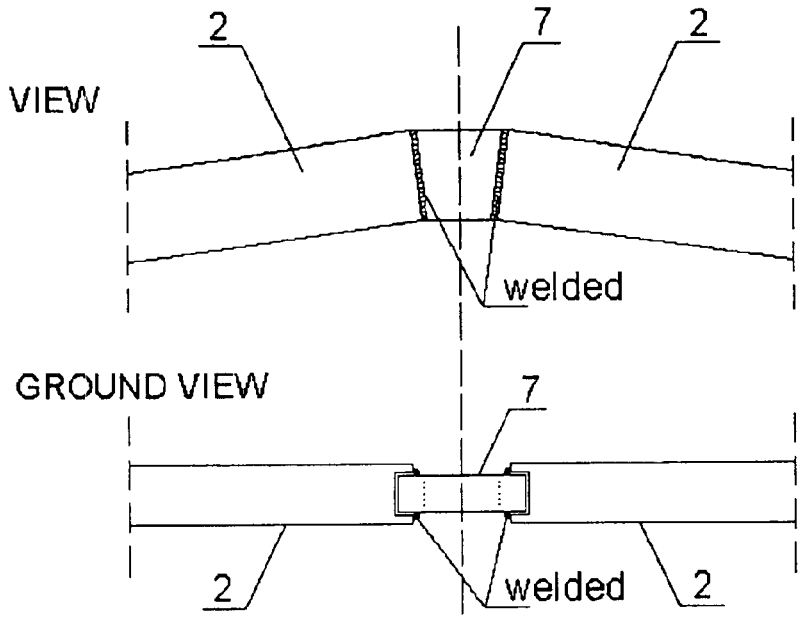
FIG. 6 is the detail of the disconnected upper construction where the prestressing force is applied.
Figure 7:
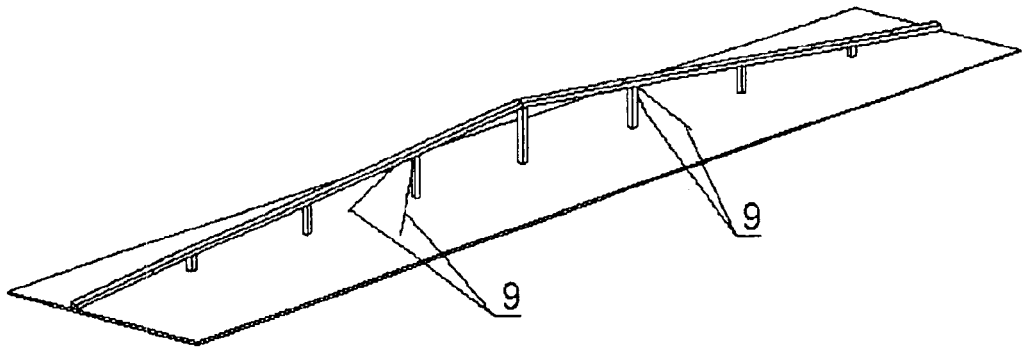
FIG. 7 presents the manner how the upper construction is prevented against buckling.

The upper steel construction (2), separated at a middle span symmetrically at two equal parts, is placed to the mould (6) for concreting the soffit plate (1) to stand on vertical element (3). The steel tendons are prestressed at the mould (4), being previously conducted through holes (5) at the ends of bars (3) and the soffit plate (1) is then concreted. After concrete hardening, fastened by the steam curing process, tendons (4) are released from the mould (6). Thus, the first prestressing step is over.

At the interuption of the steel construction (2), into the prepared detail, that lessens the stress concentration, the steel wedge (7) is positioned and the driving device (8) that pushes the wedge is prepared. Driving the wedge inside of the detail (7), both separated parts of upper construction (2) are prestressed whereby the introduced force is controlled by measuring upward deflection of the soffit plate (1) at the middle span and measuring the wedge driving force by manometer pressure on the driving device (8). From the results of these two measures, the introduced force can be reliably calculated.

The double prestressed, composite, roof-ceiling constructions with flat-soffit are intended for constructing large-span industrial buildings and similar large span buildings. Due to their specific solutions there are many advantages when compared to some custom constructing systems such as: the plate-like, large elements solve at once both roof and the ceiling with finished soffit. An aesthethic soffit closes the wasted space between sloping roof girders and reduces the heated volume of the interior that saves heating energy.

The naturally ventilated space between ceiling and roof is formed that enables all kinds of installations to be guided invisibly through the shallow loft space, instead of being guided through the interior of the building and is more expensive.

Use of the plate-like, large-panel elements that cover the big portion of the roof at once has many advantages compared to many custom constructing methods where primary and secondary girders are used. An aesthetic soffit closes the wasted space between sloping roof girders and reduces the heated volume of the interior that saves heating energy.

The safety of workers at a height during constructing is ensured after the soffit plates are assembled whereby the thermo insulation can be placed on the wide flat plane, working in a standing position is enabled without need to climb the girders. The low costs of these constructions is due to the fact that the roof-ceiling plates that comprise the finally finished soffit is simultaneously the bearing construction, with low material cost. The prestressing pushing-apart method is cheap, the large-panel roof-ceiling construction that is quickly assembled covers a large portion of the roof at once and the surface to volume ratio of these elements is suitable for quick concrete hardening by steam that enables rapid production.

Due to above mentioned advantages of the flat sofitt on which an arbitrary deep thermoinsulation can be placed close to the shallow, naturally ventilated loft space these constructions are suitable for buildings with fine, climate controlled interiors such as fine industries, big markets, sports stadiums and similar buildings.

What is claimed is:

1. A double prestressed, composite, roof-ceiling construction with flat-soffit construction for constructing large-span buildings, the prestressed, composite, roof-ceiling construction with flat-soffit comprising a wide and thin, finished, centrally prestressed concrete soffit plate and a two-part upper steel beam, the two-part upper steel beam being connected to the concrete soffit plate by vertical elements, the concrete soffit plate being prestressed centrally, the two-part upper steel beam being prestressed by a wedge located in a central gap in the two-part upper steel beam and the wedge separating the two steel parts and being weld connected to the two steel parts at centrally located ends of the two steel parts.

2. The prestressed, composite, roof-ceiling construction with flat soffit as claimed in claim 1, wherein the connection between the concrete soffit plate and the two-part steel beam is realized by concrete vertical elements having through holes at bottom ends of the concrete vertical elements having prestressed tendon strands conducted through the holes serving the to hold reinforcing welded meshes.

3. The prestressed, composite, roof-ceiling construction with flat soffit as claimed in claim 1, wherein the two-part upper steel beam is prevented against buckling by a pair of lateral elements anchored in the concrete soffit plate.

4. The prestressed, composite, roof-ceiling construction with flat soffit as claimed in claim 1, wherein the wedge introduces a prestressing force at an eccentricity over a center of gravity of a cross-section of the beam and the wide and thin concrete soffit plate is rotated at opposite ends to camber upwards.

* * * * *